United States Patent [19]

Walsh

[11] Patent Number: 4,674,744

[45] Date of Patent: Jun. 23, 1987

[54] BATTING PRACTICE ASSEMBLY

[76] Inventor: William A. Walsh, 209 Circle Ave., Forest Park, Ill. 60130

[21] Appl. No.: 470,592

[22] Filed: Feb. 28, 1983

[51] Int. Cl.[4] ..... A63B 69/40

[52] U.S. Cl. ..... 273/26 E

[58] Field of Search ..... 273/26 E, 26 EA, 29 A, 273/185 C, 185 D, 196, 200 R, 200 B, 319, 331, 332, 58 C, 413, 411; 272/76, 77, 78

[56] References Cited

U.S. PATENT DOCUMENTS

| | | | |
|---|---|---|---|
| 589,986 | 9/1897 | Shay | 272/77 |
| 2,839,300 | 6/1958 | Blaha et al. | 273/26 E |
| 3,006,647 | 10/1961 | Haskett | 273/26 E |
| 3,042,401 | 7/1962 | Denegre | 273/26 E |
| 3,114,546 | 12/1963 | Verseghy | 272/78 |
| 3,216,723 | 11/1965 | Galezniak | 273/58 C |
| 3,310,306 | 3/1967 | Burt | 273/58 C |
| 3,366,383 | 1/1968 | Lentine | 273/26 E |
| 3,442,510 | 5/1969 | Sorensen | 273/26 E |
| 3,601,398 | 8/1971 | Brochman | 273/58 C |
| 3,716,235 | 2/1973 | Yerkie | 273/26 E |
| 3,994,494 | 11/1976 | Kelley | 273/26 E |

*Primary Examiner*—Anton O. Oechsle
*Assistant Examiner*—T. Brown
*Attorney, Agent, or Firm*—Niblack & Niblack

[57] ABSTRACT

A batting practice assembly is provided to consistently position a baseball at a desired height in a strike zone. The batting practice assembly has a swinging control mechanism with laterally opposed pivot arms which pivotally hang from a collapsible and foldable frame for compact storage and shipment as well as for enhanced structural support and stability.

4 Claims, 10 Drawing Figures

FIG. 1
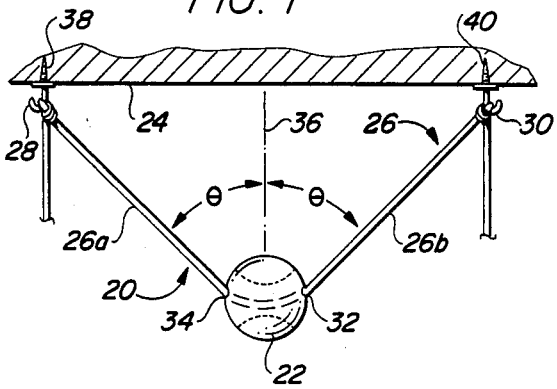
FIG. 2
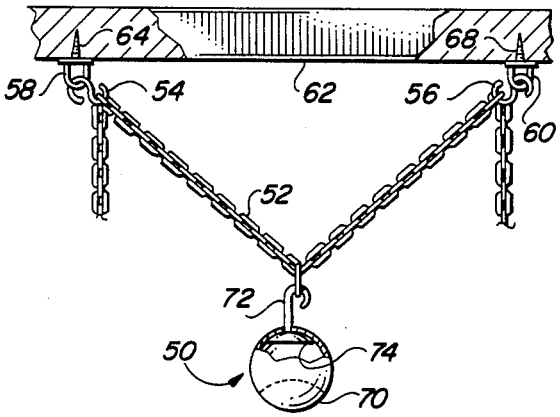
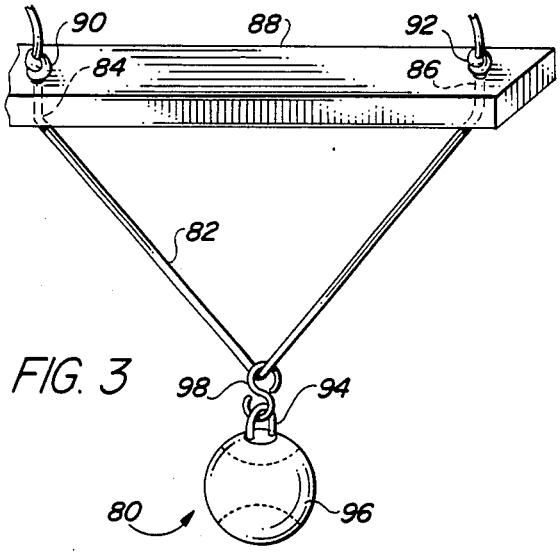
FIG. 3
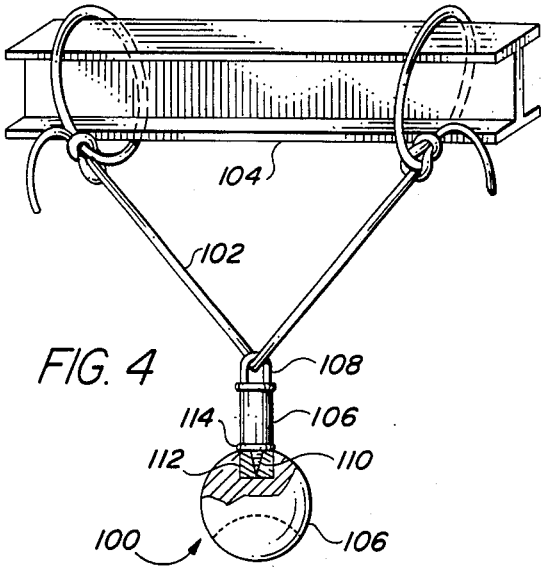
FIG. 4
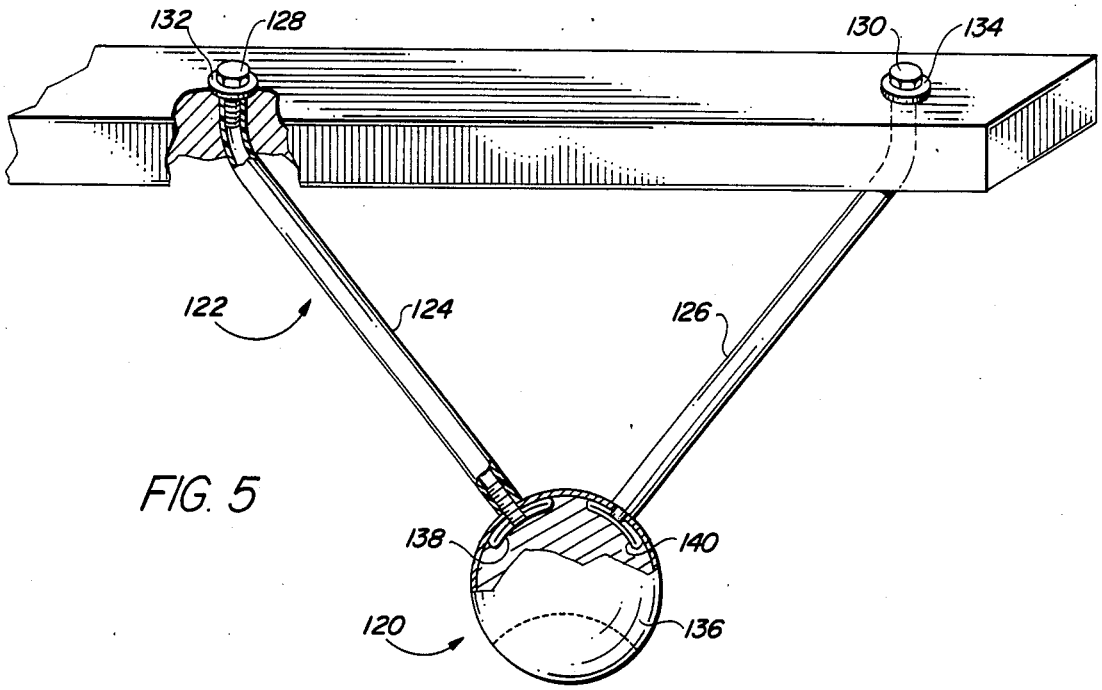
FIG. 5

BATTING PRACTICE ASSEMBLY

BACKGROUND OF INVENTION

1. Field of the Invention

The present invention relates to a batting practice device, and more specifically relates to a baseball batting practice device which can be utilized in a confined space by an unassisted, single player.

2. Description of the Prior Art

Batting skills are crucial to the game of baseball. The development, improvement and maintenance of batting skills requires a great deal of practice. It is not always practical or possible to employ a pitcher or an automated pitching machine in batting practice. Further, a device which is inexpensive, can be used by a single player in a confined space to allow players to practice regardless of the weather, at their own pace and at their convenience.

In an effort to provide such a practice system, a number of devices have been developed. See, for example Haskett U.S. Pat. No. 3,006,647 issued Oct. 31, 1961 and Blaha U.S. Pat. No. 2,839,300, issued June 17, 1958, and Kelly U.S. Pat. No. 3,994,494, issued Nov. 30, 1976. While Haskett, Blaha et al and Kelly provide a batting practice device which can be employed in a limited space, and which have the further advantages of being used by a single player and eliminate the necessity of retrieving balls used in batting practice, the prior art devices suffer from the disadvantage of employing a free moving ball with an uncontrolled arc.

Attempts to over come devices having erratic and unpredictable ball paths are found in the disclosures of Lentine U.S. Pat. No. 3,366,383 and Sorenson U.S. Pat. No. 3,442,510. The Lentine device attempts to provide a ball which travels in the normal strike zone only when the ball is at rest, and there are no assurances that the ball will return in relatively the same starting position. In the case of Lentine, Sorenson, Blaha et al and Haskett, the batter is in constant danger of being struck in the face, back and other part of the body by the ball on its return flight.

Sorenson provides an exercise device having a tethered projectile on an elastic tether. While Sorenson attempts to eliminate the danger of a batter being struck by the ball on its return flight, the ball is positioned in the middle of the frame, and the batter must stand behind the ball to hit it and then move out of the way to avoid being hit.

It is therefore desirable to provided an improved batting practice assembly which overcomes most, if not all, of the disadvantages of the prior art practice devices.

SUMMARY OF THE INVENTION

An improved batting practice assembly is provided which is easy to use, dependable and economical. The novel batting practice assembly is constructed and arranged to assure the safety of the batter by protecting the batter from being struck with the ball in the face, back or other parts of the body on the return flight of the ball when the ball is batted.

The novel batting practice assembly is also more efficient and effective than prior art batting practice devices because it assures that each ball that moves towards the batter crosses the strike zone. This gives the batter more practice time. It also gives the batter the ability to significantly improve his skills in hitting curve balls that move downwardly, outwardly and inwardly at a preselected height across the strike zone.

The inventive batting practice assembly is also versatile to meet the needs of the user and relatively simple to construct. In the novel batting practice assembly, the ball can be suspended from a ceiling, overhead beam or crossbar. The ball can also be supported by a support platform or frame assembly standing on a floor or the ground. The support platform and frame assembly are preferably portable for mobility and can have netted sidewalls, rearwalls and/or top walls to dampen the ball after it is hit as well as to further protect the batter. Desirably, the batting practice assembly is collapsable and foldable for compact storage and shipment.

Inorder to effectively control the arc of the ball to pass across the strike zone, the batting practice assembly has a swinging mechanism with a pair of separate or integrally connected pivot arms that are attached to the ball at an angle of inclination. The swinging mechanism can be provided by one or more semirigid members such as by wires, cables, chains or plastic tubing. Preferably, the swinging mechanism is provided by one or more flexible members such as by rope or elastic lines. The batting practice assembly can also have adjustable loops, turnbuckles, takeup spools, cranking devices, pulleys or other means for adjusting the striking height of the ball in the strike zone.

While the pratice assembly is particularly useful for baseball players, it can also be effectively used by tennis players, golfers, racquetball players, handball players, soccer players and football punters, by using the appropriate game ball and striking medium and adjusting the height of the ball to the appropriate level.

A more detailed explanation of the invention in provided in the followng description and appended claims taken in conjunction with the accompanying drawings.

BRIEF DESCRIPTION OF THE DRAWINGS

FIG. 1 is a front view of a baseball practice assembly in accordance with principles of the present invention;

FIG. 2 is a front view of another baseball practice in accordance with principles of the present invention;

FIG. 3 is a perspective view of still another baseball practice assembly in accordance with principles of the present invention;

FIG. 4 is a fragmentary perspective view of a further baseball practice assembly in accordance with principles of the present invention;

FIG. 5 is a fragmentary perspective view of another type of baseball practice assembly in accordance with principles of the present invention;

DETAILED DESCRIPTION OF THE PREFERRED EMBODIMENTS

Figure 6:
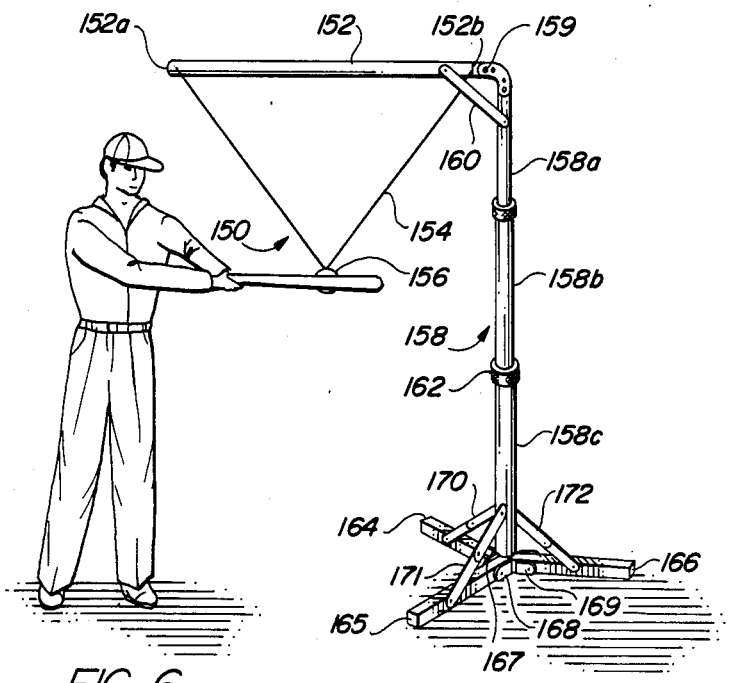
FIG. 6 is a perspective view of still another type of baseball practice assembly in accordance with principles of the present invention.

Referring now to FIG. 1, a baseball practice assembly 20 provides an improved hitting and striking device to enhance the batting skill of a baseball player. Baseball practice assembly 20 has a baseball or softball 22 pivotally and swingingly suspended from a horizontal ceiling 24 by means of a rope, cable or rubber coated wire 26 via ceiling hooks 28 and 30.

The rope, cable or wire 26 extends through a transverse hole or opening 32 in the ball. The opening can be fitted with a plastic or metal sleeve 34 to minimize wear of the rope. The portions of the rope, cable or wire extending between the ball and the hooks 28 and 30 provide a pair of laterally opposed pivot arms **26*a* and 26*b* respectively. The pivot arms are equal in length and are each at the same angle $\theta$ of inclination relative to a vertical axis 36** entending through the ball so the ball is in the middle of the rope, wire or cable. The angle $\theta$ preferably ranges from 30 to 60 degrees, and most preferably 45 degrees, for best effective results. The smaller angles in the preferred range help minimize rope, wire and cable interferance with the effective curved hitting area(striking area) of the ball, while larger angles in the preferred range help minimize large lateral swinging and swaying movements. The 45 degree angles provides the best balance.

The described rope, wire or cable provides a swinging control mechanism for consistantly returning the ball to a preselected height in a strike zone. The rope, wire or cable is adjustably, removably, and pivotally attached(connected) to the overhead ceiling hooks 28 and 30, such as with a clove hitch knot or other adjustable knot or a removable tie strap, to adjust the height of the ball in the strike zone. Excess rope, wire or cable is provided for use in lowering the ball. The rope, wire or cable is raised and the slack is tightened, to shorten the pivot arms when raising the ball. Other height adjustment means can also be used, such as pulley arrangments, takeup spools, turnbuckles, cranking devices, etc.

The ceiling provides an overhead horizontal support member. The hooks have threaded ends 38 and 40 which screw into the ceiling. Hollow wall fasteners and/or spreadable butterfly clamps can be used in conjunction with the hooks. The hooks define pivot points about which the swinging control mechanism swings and pivots. The pivot arms of the swinging control mechanism are pivotally connected to the hooks about the pivot points. The ceiling is generally horizontally aligned with and extends horizontally between the hooks defining the pivot points.

In use, the baseball player hits(strikes) the ball when the rope, wire or cable of the swinging control mechanism is in or near a vertical position so that the ball is at the preselected height in the strike zone. This occurs when the ball is at rest. It also occurs when the ball returns rearwardly through the strike zone. Hitting the ball with the bat will propel the ball and swinging mechanism forwardly in an arc from the vertical position to a forward position and then toward the rearward position. The maximum forward and rearward positions are limited by the lengths of the pivot arms. The pivot arms cooperate with each other to guide each rearward swing(flight) of the ball to the preselected height in the strike zone and substantially prevent horizontal tetherball-like rotation of the ball. This arrangement substantially prevents the players from being struck in the face, back or other portions of the body after the ball is hit. Because the ball will always return through the strike zone on each rearward flight, this arrangement gives the player more practice time to hit the ball. It also provides the batter the opportunity to hit curve balls as they move downwardly, outwardly and inwardly across the strike zone at the preselected height on its rearward flights. Advantageously, the practice assembly can be used by a single batter without the assistance of other persons.

The batting practice assembly 50 of FIG. 2 is structurally and functionally similar to the batting practice assembly 20 of FIG. 1, except that the swinging control mechanism 52 is a chain which is connected by S hooks 54 and 56 to rings or ringlets 58 and 60, respectively secured to an overhead horizontal wooden beam 62. The rings are attached to the beam by threaded fasteners 64 and 68. The beam provides the overhead horizontal support member which extends horizontally between and in horizontal alignment with the rings. The rings serve the same function as the hooks in FIG. 1 and hooks can be used in lieu of the rings, if desired. The ball 70 is connected to and suspended below the chain by a J hook 72. The expandable base 74 of the hook securely fits inside the ball and is bigger than the stem of the hook to prevent the ball from coming off the hook. If desired, epoxy resin or other glue can be used with or in lieu of the base to secure the J hook to the ball. The swinging arrangement of FIG. 2 moves the pivot arms and the entire chain above the ball to maximize the available curve hitting area of the ball. Positioning the ball below the pivot arms and swinging mechanism as in FIG. 2, desirably increases the available hitting area of the ball over the arrangment of FIG. 1.

The batting practice assembly 80 of FIG. 3 is structurally and functionally similar to the embodiment of FIG. 2, except that the swinging control mechanism 82 is an elastic line or rope which fits through vertical holes 84 and 86 in the beam 88 and is tied against the top of the beam by enlarged knots 90 and 92. The maximum diameter of the knots are larger than the maximum diameter of the holes to prevent the ball from falling below the desired height. The rope is connected to a ring or ringlet 94 secured to the ball 96 by S hook 98. The ring can be secured to the ball by epoxy resin or fasteners.

The batting practice assembly 100 of FIG. 4 is structurally and functionally similar to the previous embodiments, except the swinging control mechanism 102(rope, wire,etc.) is tied in loops about a horizontal metal I-beam 104 and a connector 106 is used to connect the swinging control mechanism to the ball. The connector has an eyelet or ring 108 which slidably receives the rope or wire of the swinging control mechanism. The bottom of the connector is a thread stud 110 which screws into a internally threaded socket 112 or hollow wall fastener inside the ball. The connector can have an annular flange 114 which rests against the ball.

The batting practice assembly 120 of FIG. 5 is structurally and functionally similar to the previous embodiments, except the swinging control mechanism 122 is provided by plastic tubing and the pivot arms 124 and 126 are separated rather than integrally connected to each other as in the previous embodiments. The tubular pivot arms fits through vertical holes in the beam as in FIG. 3, but are clamped to the top of the beam by bolts 128 and 130, washers 132 and 134 or other fasteners.

The bottom of the tubes are connected to the ball 136 by expandable butterfly clamps 138 and 140 or by epoxy resin or other fastening means. Separated pivot arms can also be provided by ropes, wires, cables, etc.

FIG. 6 illustrates a light weight portable and mobile batting practice assembly 150 which is collapsible and foldable for compact storage and shipment. The assembly is preferably made of light weight rust resistant metal, such as aluminum. Impact resistant plastic or other materials can also be used. The batting practice assembly 150 is structurally and functionally similar to the previous embodiments except as described herein. In the batting practice assembly of FIG. 6 the overhead horizontal support member is provided by a cantilevered horizontal beam 152. The swinging control mechanism 154 can be rope, elastic line, wire, cable, chain, plastic tubing etc. as previously described and can be attached to the ball 156 and beam 152 by any of the arrangements described in the previous embodiments.

The cantilevered beam 152 has a free end 152*a* and a pivotally hinged end 152*b*. The pivotally hinged end 152*b* is pivotally and hingably connected as well as collapsably securely braced to a collapsable and expandable telescoping post 158 by a pivot pin 159 and hinge 160. Hinge(brace) 160 is of the type used on the legs of folding card tables. The post has two, three or more telescoping sections 158*a*, 158*b* and 158*c* which telescope and collapse within each other when in a retracted collapsed position. The collapsable telescoping post is lengthened to an expanded position when in use and collapsed when stored. The telescoping post can be expanded to different heights as desired by the batterand is locked in position by locking means such as turning(lock) twist grooves, roll(lock) pins, lock latches or locking clamps 162.

The bottom of the post 158 is supported by three pivotable legs 164, 165 and 166 upon a floor or the ground. The legs are pivotally and hingably connected as well as collapsibly securely braced to the bottom portion of the post by pivot pins 167–169 and hinges 170–172, respectively. Hinges(braces) 170–172 are the same type as hinge 160. The legs are foldable against the post for compact storage and shipment. Wheels or casters can be secured to the legs for additional mobility.

In use, the batter stands opposite the post 158 as shown in FIG. 6 so that the swing of the bat will not hit any structure except the ball. The swinging mechanism 154 and ball 156 function(operate) in the same manner as the previous embodiments.

Figure 7:
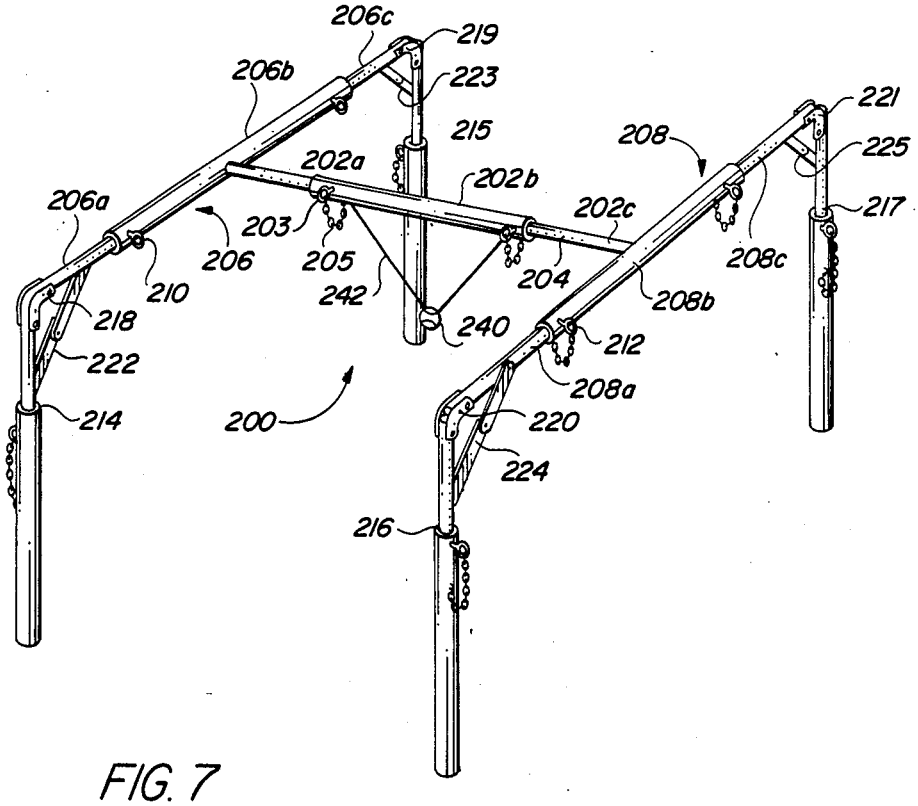
FIG. 7 is a perspective view of a further type of baseball practice assembly in accordance with principles of the present invention.

The adjustable, collapsible and foldable batting practice assembly and cage 200 of FIG. 7 has an telescoping overhead horizontal crossbar 202 which provides the overhead horizontal support member. Cross bar 202 has two, three or more sections, 202*a*, 202*b* and 202*c* which telescopingly increase or descrease the overall width of lateral span of the assembly. Crossbar 202 has twist grooves locking clamps, lock latches or roll(lock) pins 203 which fit into holes 204 in the crossbar sections and serve as locking means to securely lock the crossbar and the selected width. The pins can be securely attached to the crossbar by a chain 205. The ends of the crossbar are welded or otherwise secured to lateral telescoping beams or bars 206 and 208. If desired, the ends of the crossbar can be hingably of otherwise pivotally connected or removably attached(detachably secured) to the lateral beams. Lateral beams 206 and 208 each have two, three or more sections 206*a*, 206*b*, 206*c* and 208*a*, 208*b*, and 208*c*, which telescopingly expand and contract within each other to selectively increase or decrease the length of the practice assembly. The lateral beams have roll(lock) pins 210 and 212 and holes or other suitable locking means to securely lock the beams in the desired position. The cross end beams are H-shaped as viewed from above the top of the assembly position.

The ends of the lateral beams 206 and 208 are pivotally and hingably connected as well as collapsibly securely braced to collapsible and expandable telescoping posts 214–217 by pivot pins 218–221 and hinged(braces) 22–225, respectively. The hinges and posts are structurally function and structurally similar to the hinge 160 and post 158 of FIG. 6. The posts can be expanded or contracted to selectively increase or decrease the overall height of the batting practice assembly. The posts can each have foldable pivotable legs as in FIG. 6 for enhanced stability and case of storage. The legs, posts, beam and crossbar are preferably made of lightweight metal such as aluminum.

It can therefore be appreciated the width, length and height of the batting practice assembly 200(FIG. 7) can be adjusted as desired by the batter by expanding or contracting the crossbar, lateral beams and posts, respectively. The crossbar should be expanded to sufficient width and the lateral beam expanded to a sufficient length so that the batter can freely swing the bat at the ball 240 from beneath the crossbar without hitting the posts on a floor or even ground. The posts should be adjusted to the same height so that the crossbar remains horizontal. On uneven ground, the height of the posts can be different to compensate for the unevenness to position the crossbar substantially horizontally.

The crossbar 202(FIG. 7) beams 206 and 208 and posts 214–217 are collapsible and retractable, and the posts pivot or fold against the beams for compact storage and shipment. The crossbar beams and posts, cooperate with each other to provide an adjustable frame or cage.

The swinging control mechanism 242(FIG. 7) can be a rope, elastic line, wire, cable, chain, plastic tubing, etc. as previously described in the other embodiments and can be attached to the ball 240 and crossbar 202 by any of the arrangements described in the previous embodiments. The swinging mechanism and ball function(operate) in the same manner as the previous embodiments.

Figure 8:
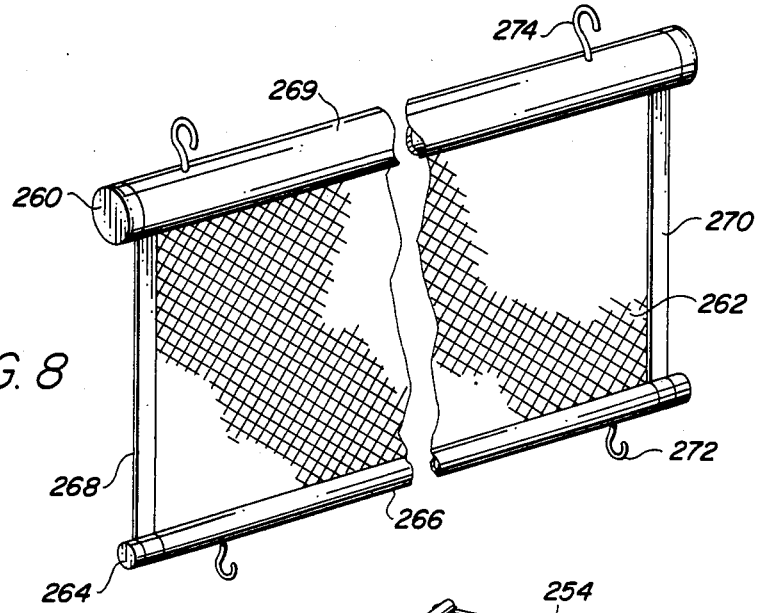
FIG. 8 is a perspective view of a retractable netted wall for use with the baseball practice assembly of FIGS. 7, 9 and 10.
Figure 9:
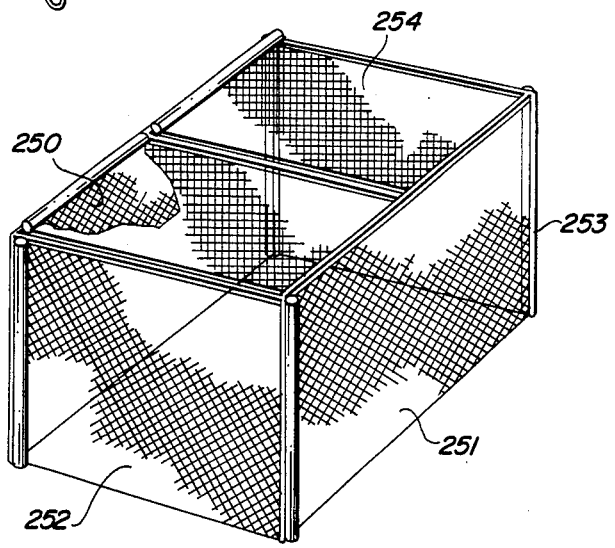
FIG. 9 is a perspective view of the baseball practice assembly of FIG. 7 equipped with netted walls.

The retractable netting of the type shown in FIG. 8 and 9 can be detachably secured as desired to the posts and legs of the batting practice assembly of FIG. 7 to provide netted side, front, rear and/or top walls 250–254 respectively.

Netted walls dampen the force of the ball and further protect the batter from being struck by the ball. In order for the netted walls to be adjustably correlated to the width, length and height of the adjustable batting practice assembly, each netted wall is expandably and retractably connected to a spring loaded roller 260. The netting 262 is sewn, stapled or otherwise attached to a retractable peripheral border 264. The border includes a transverse end portion 266 and rollable flexible fabric lateral sides of fabric of sheet plastic which retractably wrap around roller in the same manner as the netting. The transverse end portion 266 can be made of a rigid material, such as wood, metal or plastic, or can be made of flexible fabric or sheet plastic. Hooks 272 extend longitudinally from the transverse end portion 266 into holes in the posts and beams to detachably secure the end portion to the posts and beams, respectively when the netted wall is expanded and in use. The roller 269 has hooks 274 to detachably secure the roller to holes in the opposite posts or beams as shown. Snaps can be used in lieu of hooks, if desired, but snaps on the telescoping posts and beams may interfere with their adjustabliity. The netted wall and roller function(operate) in a manner similar to a window shade or retractable movie screen. Other netted wall arrangements can be used.

Figure 10:
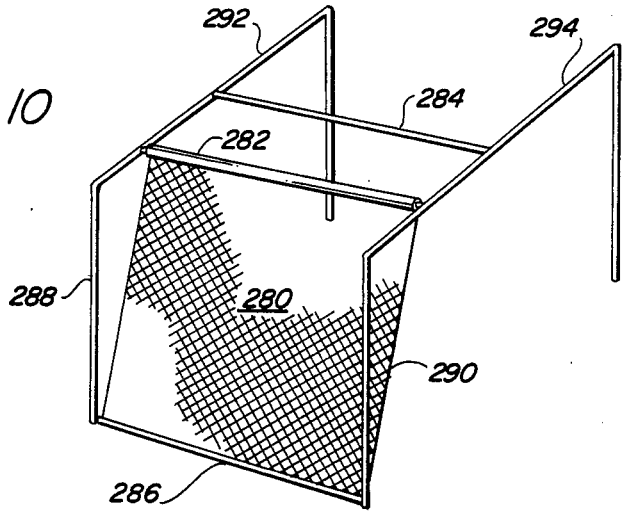
FIG. 10 is a perspective view of the baseball practice assembly of FIG. 7 equipped with a slanted netted front wall.

Sometimes it is desirable to use a slanted netted front wall 280 in the batting pratice assembly as shown in FIG. 10. In that event, the roller 282 of the netted wall should be hooked to holes in the lateral beams at a location forwardly of the crossbar 284. The end portion of bottom 286 of the netted front wall is hooked to the bottom of the front posts 288 and 290. In order to vary the angle of inclination of the slanted front wall, the telescoping lateral beams 292 and 294 are expanded or contracted to attain the desired angle.

The embodiments described above are particularly helpful for baseball players. It will be appreciated however that the practice assemblies can also be very useful for other athletes. For example, tennis players, handball players, and football players, can effectively use the inventive practice assemblies by using a different type of ball instead of a baseball as a tennis ball, racquet ball, golf ball, etc and using a different striking medium instead of a bat such as a tennis racquet, racquetball racquet, golf club, foot, hand, etc.

Although embodiments of the invention have been shown and described it is to be understood that various modifications and substitutions can be made without departing from the novel spirit and scope of this invention.

The invention claimed is:

1. A batting practice assembly comprising: collapsible frame means for compact storage and transportation and for structural support, said collapsible frame means having a substantially horizontal adjustable crossbar, said collapsible frame means including a pair of adjustable telescoping lateral beams centrally connected to the ends of said crossbar, adjustable telescoping post, and pivot pins for connecting said posts to the end of said lateral beams, and hinge means for collapsibly bracing said posts to said lateral beams; ball means having a curved hitting surface; swinging control means connected to said ball means for consistently returning said ball means to a preselected height in a strike zone and for swinging said ball means in an arc from a vertical position in said strike zone to a forward position and to a rearward position in response to said ball means being hit; a pair of attachment means for securely attaching said swinging control means to said horizontal crossbar, said pair of attachment means defining a pair of pivot points and being in generally horizontal alignment with said horizontal crossbar; said swinging control means having a pair of laterally opposed pivot arms extending between said attachment means and said ball means, said pivot arms being substantially the same angle of inclination relative to a vertical axis extending through said ball means in said vertical position and said pivot arms cooperating with each other to guide each rearward swing of the ball to said preselected height in said strike zone.

2. A batting practice assembly in accordance with claim 1 wherein said collapsible frame means further includes at least three legs, other pivot pins for pivotally connecting said legs to said posts, and other hinge means for collapsibly bracing said legs to said posts.

3. A batting pratice assembly in accordance with claim 1 wherein said collapsible frame means further includes adjustable netted wall means.

4. A batting practice assembly in accordance with claim 1 wherein said adjustable netted wall means includes an adjustable slanted netted front wall.

* * * * *